US007627985B2

(12) United States Patent
Marsden et al.

(10) Patent No.: US 7,627,985 B2
(45) Date of Patent: Dec. 8, 2009

(54) GATE LATCH ASSEMBLY

(75) Inventors: Andrew W. Marsden, Hingham, MA (US); Richard M. Bastien, Cumberland, RI (US); Robert D. Monahan, Norwell, MA (US); Trung Phung, Roslindale, MA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 11/130,639

(22) Filed: May 16, 2005

(65) Prior Publication Data

US 2006/0185253 A1 Aug. 24, 2006

Related U.S. Application Data

(60) Provisional application No. 60/655,519, filed on Feb. 23, 2005.

(51) Int. Cl.
*E06B 9/01* (2006.01)

(52) U.S. Cl. ..... 49/50; 49/57; 49/394; 49/395

(58) Field of Classification Search ..... 49/50, 49/57, 55, 394, 395; 292/137, 158, 161, 292/163, 138, 139, 143, DIG. 37
See application file for complete search history.

(56) References Cited

U.S. PATENT DOCUMENTS

| | | | | |
|---|---|---|---|---|
| 2,512,954 | A | 6/1950 | Marks | |
| 3,888,046 | A * | 6/1975 | Meisterheim | 49/319 |
| 4,520,592 | A | 6/1985 | Holloway | |
| 4,763,937 | A | 8/1988 | Sittnick, Jr. et al. | |
| 5,052,461 | A | 10/1991 | Stern | |
| 5,065,136 | A | 11/1991 | Frolov et al. | |
| 5,179,325 | A | 1/1993 | Aragon, Jr. | |
| 5,243,325 | A | 9/1993 | Marin et al. | |
| 5,272,840 | A | 12/1993 | Knoedler et al. | |
| 5,290,077 | A * | 3/1994 | Fleming | 292/35 |
| 5,367,829 | A | 11/1994 | Crossley et al. | |
| 5,396,732 | A | 3/1995 | Andersen | |
| 5,437,115 | A | 8/1995 | Freese et al. | |
| 5,442,881 | A | 8/1995 | Asbach et al. | |
| 5,457,914 | A | 10/1995 | Johnson, Jr. | |
| 5,535,552 | A | 7/1996 | Stern | |
| 5,568,123 | A | 10/1996 | Derheim | |
| 5,680,094 | A | 10/1997 | Guim et al. | |
| 5,686,890 | A | 11/1997 | Ko | |
| 5,782,039 | A | 7/1998 | Scherer et al. | |
| 5,809,694 | A | 9/1998 | Postans | |
| 5,887,856 | A | 3/1999 | Everly, II | |
| 5,924,242 | A | 7/1999 | Macari et al. | |
| 6,035,676 | A | 3/2000 | Hudspeth | |
| 6,079,157 | A | 6/2000 | Hincher, Sr. | |
| 6,112,461 | A | 9/2000 | Cheng | |
| 6,176,042 | B1 | 1/2001 | Rossman et al. | |
| 6,347,486 | B1 | 2/2002 | Badilet | |
| 6,454,324 | B1 | 9/2002 | Lewis et al. | |
| 6,499,254 | B2 | 12/2002 | Rossman et al. | |
| 6,516,568 | B2 | 2/2003 | Yang | |
| 6,536,163 | B1 | 3/2003 | Monahan et al. | |
| 6,536,502 | B2 | 3/2003 | Britto et al. | |
| 6,691,467 | B2 | 2/2004 | Hincher, Sr. | |
| 2001/0000556 | A1 | 5/2001 | Rossman et al. | |
| 2003/0009945 | A1 | 1/2003 | Cheng | |
| 2003/0197164 | A1 | 10/2003 | Monahan et al. | |

* cited by examiner

*Primary Examiner*—Gregory J. Strimbu
(74) *Attorney, Agent, or Firm*—Barnes & Thornburg LLP

(57) ABSTRACT

A gate is mounted to a gate mount for movement between an opened and a closed position. The gate includes a hand-operated latch assembly for mating with the gate mount to lock the gate in the closed position.

18 Claims, 8 Drawing Sheets

GATE LATCH ASSEMBLY

This application claims priority under 35 U.S.C. § 119(e) to U.S. Provisional Application Ser. No. 60/655,519, filed Feb. 23, 2005, which is expressly incorporated by reference herein.

BACKGROUND

The present disclosure relates to security gates and, in particular, to juvenile gates for use inside a dwelling. More particularly, the present disclosure relates to latching systems for gates.

SUMMARY

A security gate unit includes a gate and a gate mount configured to support the gate for pivotable movement from a closed position mating with a latch receiver frame and an opened position away from the latch receiver frame. The gate includes a hand-operated latching assembly for mating with the latch receiver frame to retain the gate in the closed position.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which.

DETAILED DESCRIPTION

Figure 1:
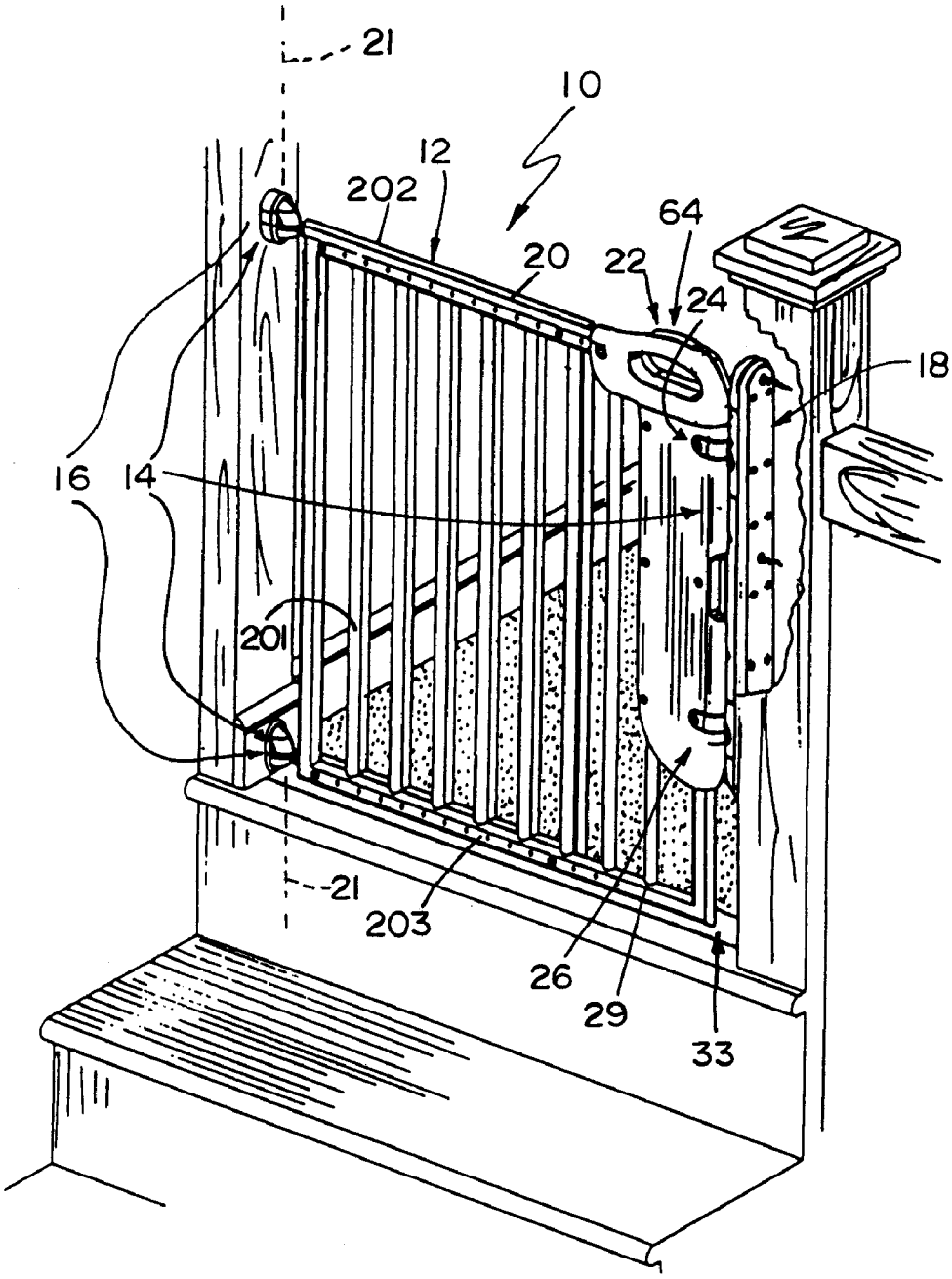
FIG. 1 is a perspective view of a security gate unit in accordance with the present disclosure showing a gate coupled to a gate mount located, for example, in a passageway of a staircase and a hand-operated latch assembly provided for opening and closing the gate.
Figure 2:
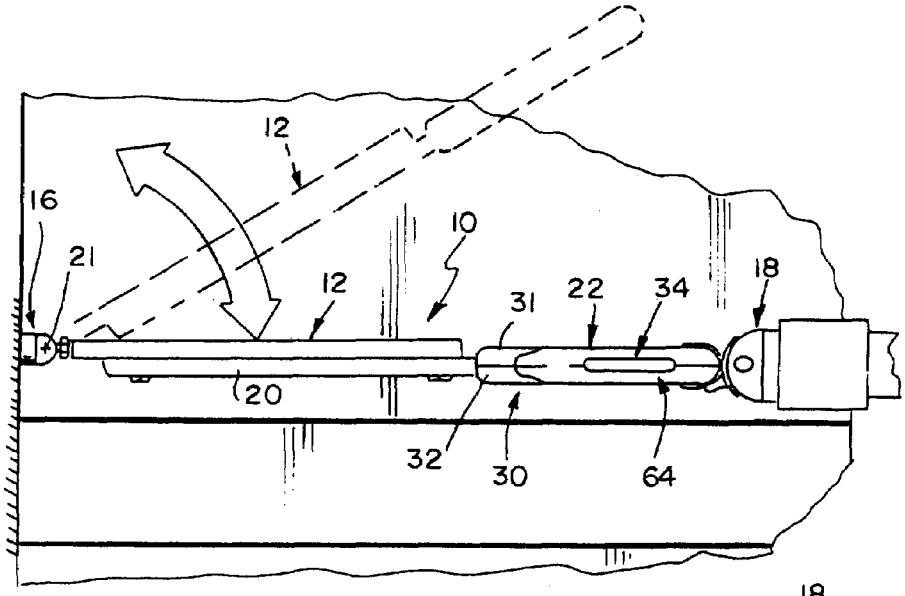
FIG. 2 is a top plan view of the gate unit showing a gate mounted to pivot between an opened position (in phantom) and a closed position (in solid) on a left-side pivot frame included in the gate mount and to mate with a right-side latch receiver frame also included in the gate mount.
Figure 3:
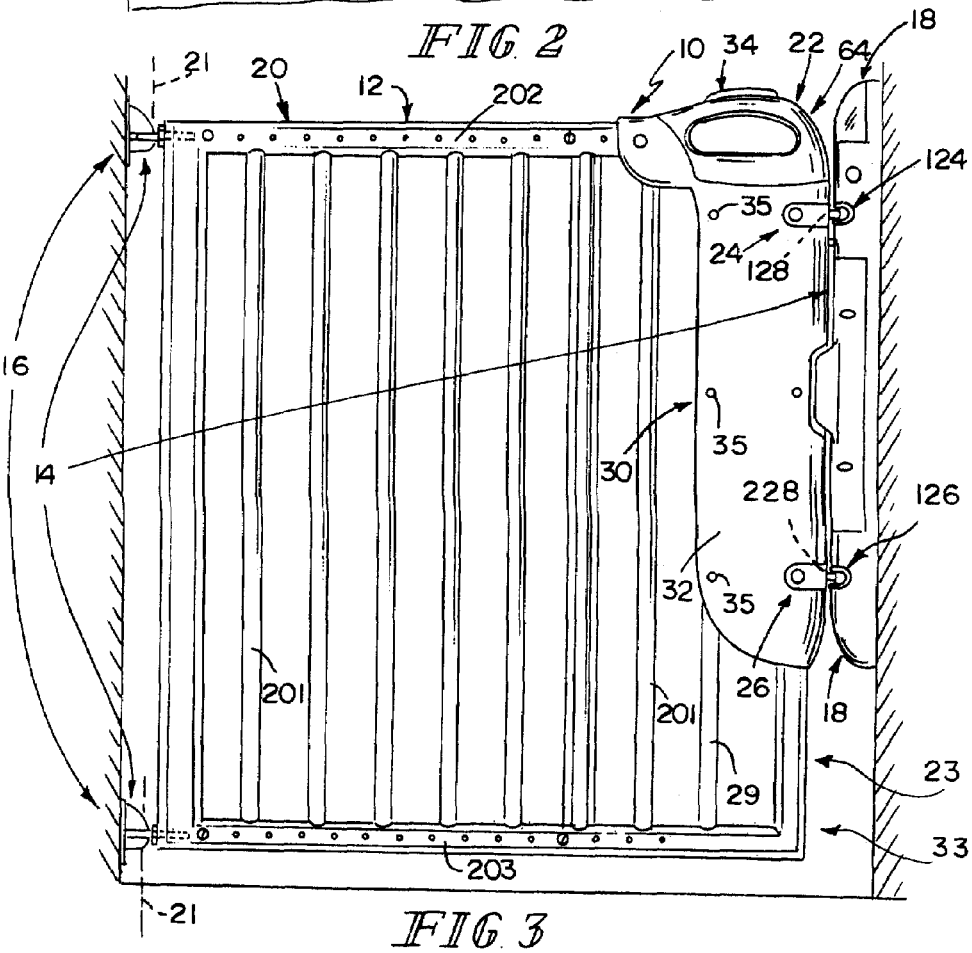
FIG. 3 is an enlarged front elevation view of the gate unit of FIGS. 1 and 2 showing the hand-operated latch assembly carried on a fence in mating engagement with the right-side latch receiver frame.

A security gate unit 10 includes a gate 12 and a gate mount 14 comprising a pivot support frame 16 on a left side of gate 12 and a latch receiver frame 18 on a right side of gate 12 as shown in FIGS. 1-3. As suggested in FIG. 3, gate 12 includes a fence 20 coupled to pivot support frame 16 for pivotable motion about a vertical pivot axis 21 and a hand operated latch assembly 22 including spring-biased upper and lower latches 24, 26 arranged to mate with latch receiver frame 18 upon movement of gate 12 to the closed position. Each latch 24, 26 includes a plunger post 28 that is movable to extend into one of the upper and lower post receivers 124, 126 formed in latch receiver frame 18 as suggested, for example, in FIGS. 5 and 6 to retain gate 12 in the closed position.

Figure 8:
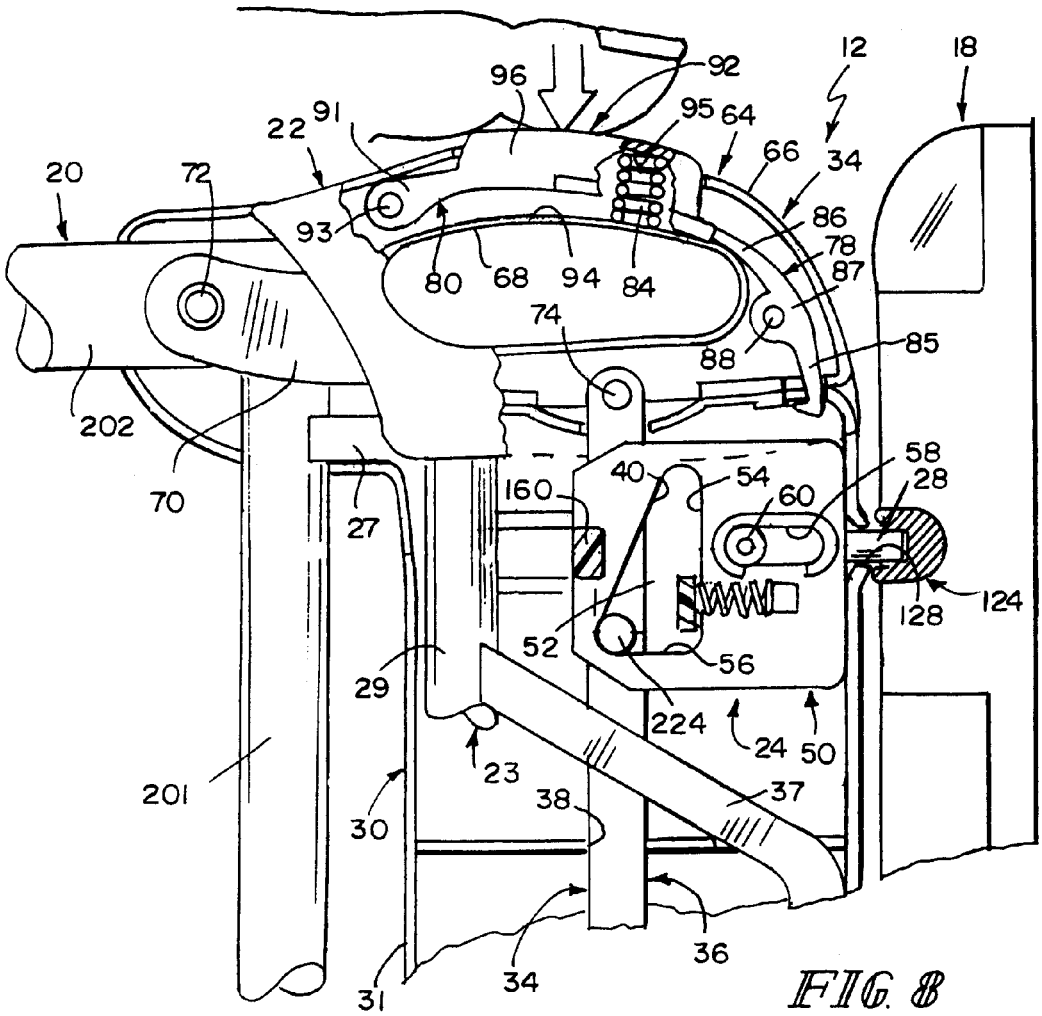
FIG. 8 is a front elevation view of the hand-operated latch assembly, with portions broken away, showing a person's thumb exerting downward pressure on a trigger provided in a handle lock included in the hand-operated latch assembly to move (e.g., pivot) a lock arm to unlock a lift handle coupled to the handle lock.
Figure 9:
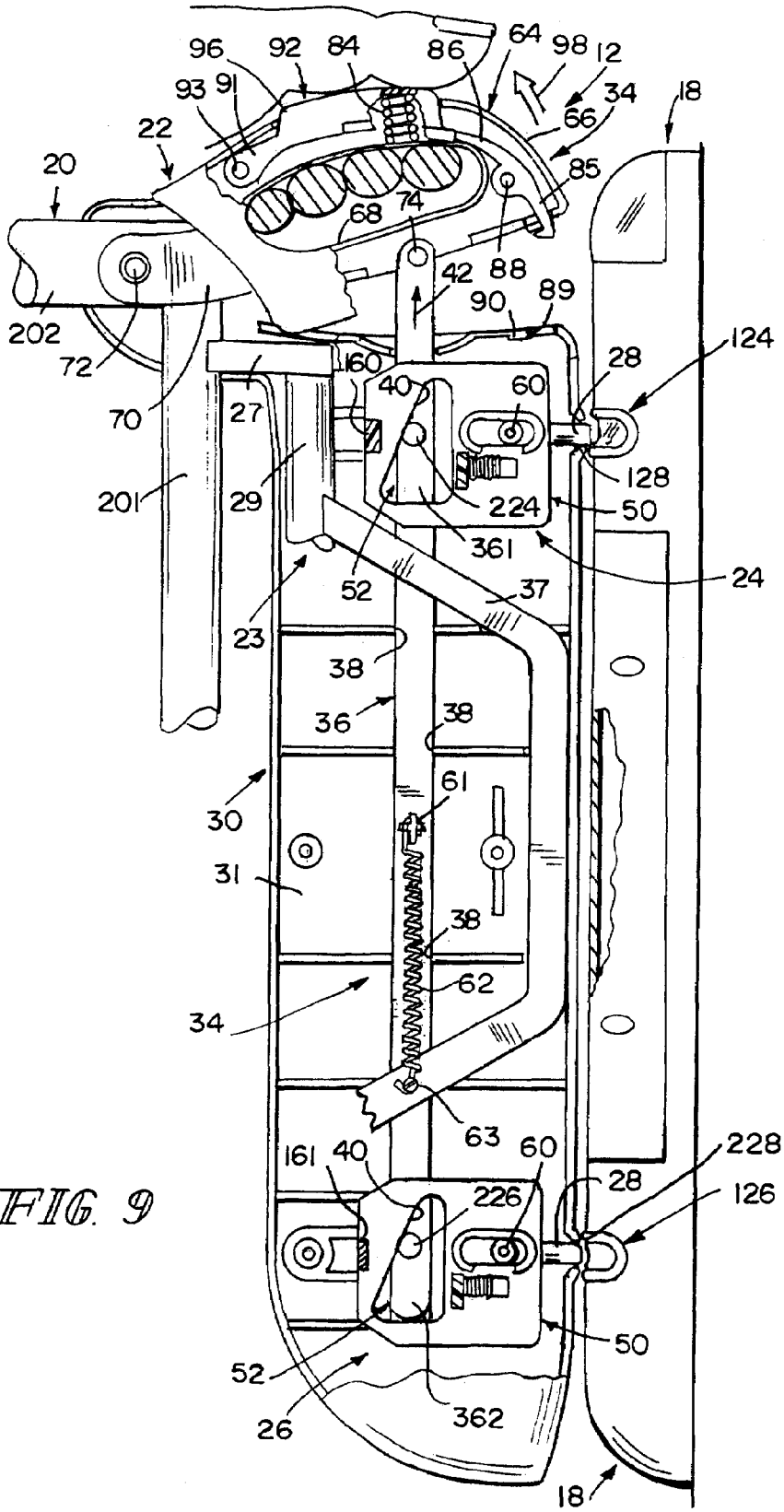
FIG. 9 is a front elevation view of the hand-operated latch assembly of FIG. 8, with portions broken away, showing a person's hand lifting the lift handle to raise the latch retractor bar in the latch base, thereby moving the upper and lower latches laterally (to the left) away from the latch receiver frame to "release" the plunger posts from the post receivers formed in the latch receiver frame so that the gate can be opened.

By using hand-operated latch assembly 22 in the manner shown, for example, in FIGS. 8 and 9, plunger posts 28 can be withdrawn from upper and lower post receivers 124, 126 against yieldable spring-biasing forces applied to upper and lower latches 24, 26 so that gate 12 may be opened. During gate closure, plunger posts 28 are able to move laterally as needed to retract into gate 12 and then "snap back" into upper and lower post receivers 124, 126 formed in latch receiver frame 18 as suggested in FIGS. 10 and 11.

As suggested, for example, in FIGS. 2-5, hand-operated latch assembly 22 includes a latch base 30 comprising mating first and second support shells 31, 32 and a latch mover 34 mounted for movement in latch base 30 to control lateral movement of upper and lower latches 24, 26 relative to latch base 30. First and second shells 31, 32 cooperate to form an upper aperture 128 receiving the movable plunger post 28 of upper latch 24 therein and a lower aperture 228 receiving the movable plunger post 28 of lower latch 26 therein as shown, for example, in FIGS. 7, 9, and 11.

In the illustrated embodiment, latch mover 34 is configured to allow projection of plunger post 28 of upper latch 24 through upper aperture 128 of latch base 30 into upper latch receiver 124 of latch receiver frame 18 and also projection of plunger post 28 of lower latch 26 through lower aperture 228 of latch base 30 into lower latch receiver 126 of latch receiver frame 18 upon movement of gate 12 to the closed position relative to latch receiver frame 18 as suggested in FIGS. 3, 8, and 9. Latch mover 34 also provides means for withdrawing plunger posts 28 from upper and lower latch receivers 124, 126 formed in latch receiver frame 18 as suggested in FIGS. 7 and 9 to permit a user to pivot gate 12 about vertical pivot axis 21 to an opened position (shown in phantom in FIG. 2).

Figure 4:
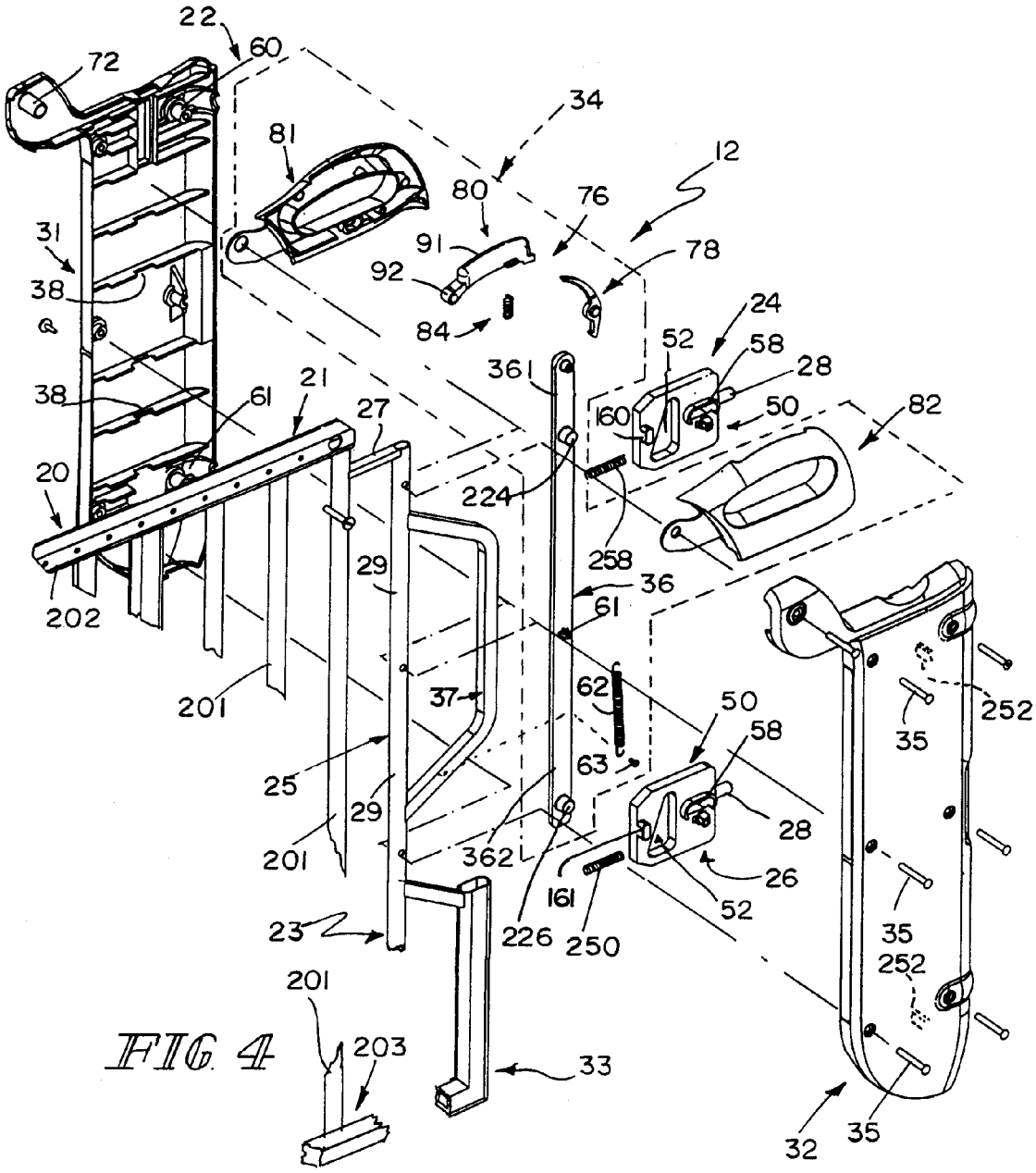
FIG. 4 is an exploded perspective view of a portion of the fence and components included in the hand-operated latch assembly of FIGS. 1-3.
Figures 5, 6:
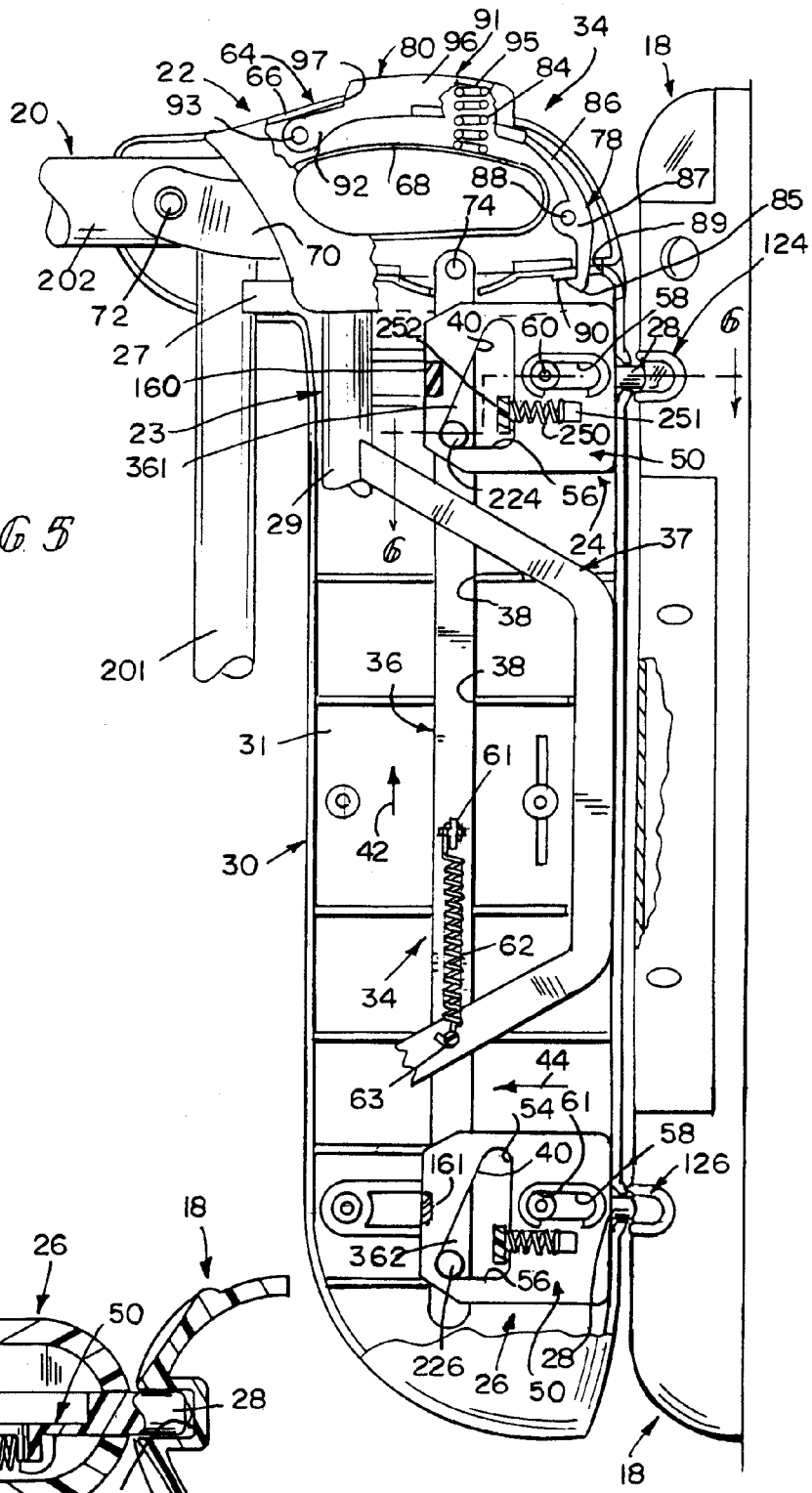
FIG. 5 is a front elevation view of the hand-operated latch assembly of FIGS. 1-4, with portions broken away, showing an upper plunger post included in an upper latch urged by a spring to project into a companion post receiver formed in an upper portion of the right-side latch receiver frame, a lower plunger post included in a lower latch urged by another spring to project into a companion post receiver formed in a lower portion of the right-side latch receiver frame, a downwardly biased vertical latch retractor bar coupled to both of the upper and lower latches, and a retractor bar lift handle mounted to pivot on a pivot pin coupled to the fence, coupled to a top end of the latch retractor bar, and configured to carry a trigger-actuated handle lock arm.
FIG. 6 is a sectional view, taken along line 6-6 of FIG. 5, showing the gate in a closed position, a plunger post included in the upper latch, and a coiled compression spring interposed between a first spring mount included in the upper latch and a second spring mount included in one of the two support shells cooperating to define a latch base containing the upper and lower latches and the latch retractor bar, and showing expansion of the coiled compression spring to urge the upper latch (to the right) toward the right-side latch receiver frame to move the plunger post into a post-receiver formed in the right-side latch receiver frame of the gate mount.

Latch mover 34 includes a latch retractor bar 36 supported for up-and-down movement in a guide channel 38 provided in latch base 30 and formed, for example, in first support shell 31 as suggested in FIGS. 4-6. An upper latch retractor pin 224 (included in latch mover 34) is coupled to an upper portion 361 of latch retractor bar 36 and arranged to "ride on" a latch retraction ramp 40 provided on upper latch 24 (in camming relation) so that upward movement of latch retractor bar 36 in direction 42 causes lateral movement of upper latch 24 in direction 44 away from latch receiver frame 18 to withdraw plunger post 28 of upper latch 24 from its companion upper latch receiver 124 in latch receiver frame 18 as suggested in FIGS. 7 and 9. Similarly, a lower latch retractor pin 226 (included in latch mover 34) is coupled to a lower portion 362 of latch retractor bar 36 and arranged to ride on a latch retraction ramp 40 provided on lower latch 26 (in camming relation) so that upward movement of latch retractor bar 36 in direction 42 causes lateral movement of lower latch 26 in direction 44 away from latch receiver frame 18 to withdraw plunger post 28 of lower latch 26 from its companion lower latch receiver 126 in latch receiver frame 18.

Fence 20 includes a barrier 19 defined, for example, by vertical spindles 201 interconnecting horizontal spaced-apart top and bottom rails 202, 203 as shown in FIGS. 1 and 4. Frame 20 also includes a free-end unit 23 coupled to a free end of barrier 19 and arranged to lie in closely confronting relation to latch receiver frame 18 when gate 12 is moved to assume the closed position as suggested in FIGS. 3 and 4. Free-end unit 23 is configured to support hand-operated latch assembly 22 for movement with barrier 19 as gate 12 is opened and closed.

Free-end unit 23 of fence 20 includes a frame 25 and a latch retractor bar retainer 37 coupled to frame 25 as suggested in FIG. 4. Frame 25 comprises horizontal link 27 coupled to one of the spindles 201, a tube 29 extending downwardly from link 27 to lie in spaced-apart relation to that spindle 201, and a base 33 coupled to tube 29 and to bottom rail 203 as shown best in FIG. 4. As suggested in FIGS. 3 and 4, first and second support shells 31, 32 are coupled to tube 29 to lie above base 33 using suitable fasteners 35.

Figure 7:
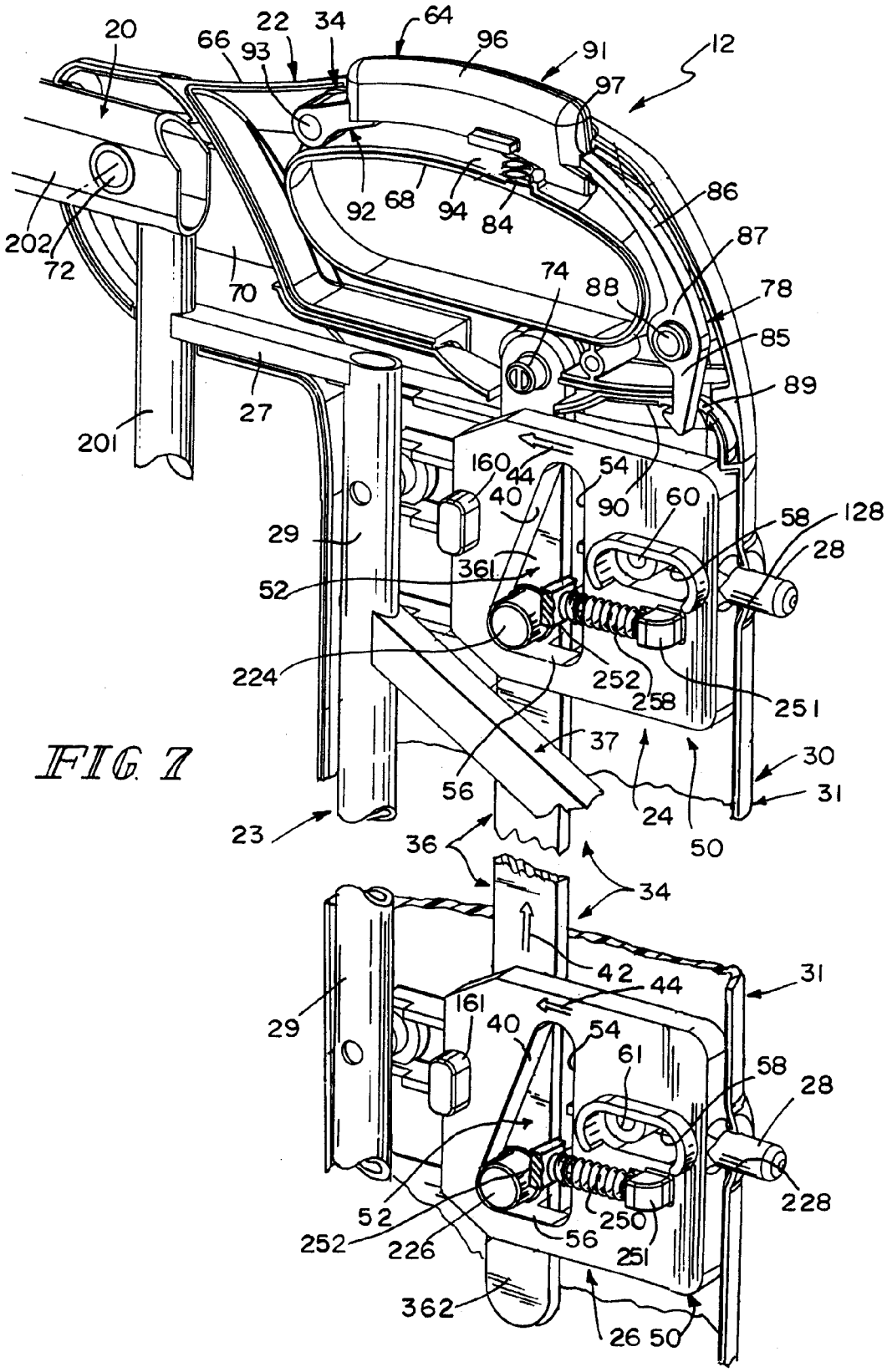
FIG. 7 is an enlarged, segmented perspective view of portions of the hand-operated latch assembly of FIG. 3.

Upper latch 24 is configured as shown, for example, in FIGS. 4, 6, and 7. In the illustrated embodiment, lower latch 26 is a duplicate of upper latch 24 and is shown, for example, in FIGS. 4 and 7. Each latch 24, 26 is configured and constrained to move laterally relative to first and second shells 31, 32 of latch base 30 to withdraw plunger posts 28 from companion post receivers 124, 126 in latch receiver frame 18 in response to predetermined movement of latch retractor bar 36 in guide 38 formed in first shell 31. Latch bar retractor retainer 37 is arranged to lie in the interior region of latch base 30 in a position between latch retractor bar 36 and second support shell 32 to retain latch retractor bar 36 in guide channel 38 as latch retractor bar 36 moves up and down in guide channel 38.

In the illustrated embodiment, upper latch 24 includes a post carrier 50 coupled to plunger post 28 and formed to include a pin-receiving opening 52 bordered, in part, by latch retraction ramp 40. Illustratively, pin-receiving opening 52 has a somewhat triangular shape defined by vertical border 54 and horizontal border 56 along with latch retraction ramp 40 that is inclined to form the "hypotenuse" of the triangle-shaped pin-receiving opening 52. As shown best in FIGS. 5-7 and 9, latch retractor pin 224 extends into pin-receiving aperture 52 formed in post carrier 50 to ride back and forth along inclined latch retraction ramp 40 during up-and-down movement of latch retractor bar 36 in guide channel 38 relative to latch base 30.

Post carrier 50 of upper latch 24 is also formed to include a horizontal guide slot 58 sized to receive for back-and-forth sliding movement therein a guide pin 60 appended to an inner wall of first support shell 31 as shown in FIG. 4. Guide pin 60 is cantilevered to first support shell 31 and arranged to extend toward second support shell 32 and into horizontal guide slot 58 as shown in FIGS. 5 and 7 to help guide sliding movement of post carrier 50 in an interior space provided between first and second support shells 31, 32 of latch base 30. Similarly, another guide pin 61 is cantilevered to first support shell 31 and arranged to extend into a horizontal guide slot 58 associated with lower latch 26.

Post carrier 50 of upper latch 24 is also formed to include a guide pin 160 shown in FIGS. 5-7. Guide pin 160 is arranged to extend toward second support shell 32 and into a horizontal guide slot 158 formed in second support shell 32 as suggested in FIG. 4. Upper latch 24 is constrained to move laterally (e.g., horizontally) in the interior region of latch base 30 owing, in part, to relative movement of guide pin 160 on post carrier 50 in horizontal guide slot 158 in second support shell 32 and relative movement of guide pin 60 on first support shell 31 in horizontal guide slot 58 in post carrier 50. Guide pin 161 on post carrier 50 of lower latch 26 extends into a horizontal guide slot 159 formed in second support shell 32 as suggested in FIG. 4 and provides a similar lateral-movement constraint for lower latch 26 latch base 30.

As shown best in FIGS. 5-7, a coiled compression spring 250 is interposed between a first spring mount 251 provided on post carrier 50 of upper latch 24 and a second spring mount 252 provided on an interior wall 253 of second support shell 32. Under normal conditions, spring 250 expands to yieldably urge post carrier 50 to the right toward latch receiver frame 18, and this movement urges the plunger post 28 on post carrier 50 to project through upper aperture 128 formed in latch base 30 into post receiver 124 formed in latch receiver frame 18. A similar spring-biasing system is provided for lower latch 26 as also shown in FIGS. 5 and 7.

Latch mover 34 further includes a retractor bar return spring 62 and a retractor bar lift handle 64. Retractor bar return spring 62 provides means for normally moving latch retractor bar 36 downwardly in guide channel 38 to a lowered position allowing "spring-biased" movement of post carriers 50 in upper and lower latches 24, 26 toward latch receiver frame 18 to project plunger posts 28 in upper and lower latches 24, 26 into companion post receivers 124, 126 formed in latch receiver frame 18 as shown, for example, in FIGS. 3, 5, and 8. Retractor bar lift handle 64 is mounted to be moved relative to latch base 30 to provide means for lifting latch retractor bar 36 upwardly in guide channel 38 against an opposing force applied by retractor bar return spring 62 to move simultaneously post carriers 50 of both upper and lower latches 24, 26 laterally away from latch receiver frame 18 (against spring-biasing forces acting on upper and lower latches 24, 26) to withdraw plunger posts 28 from post receivers 124, 126 formed in latch receiver frame 18 as shown, for example, in FIG. 9. Upon release of retractor bar lift handle 64 by a person using gate 12, retractor bar return spring 62 functions to return latch retractor bar 36 to its lowered position to allow spring-biasing forces acting on upper and lower latches 24, 26 to move plunger posts 28 to a projected position ready to extend (once again) into post receivers 124, 126 formed in latch receiver frame 18 upon swinging movement of gate 12 about pivot axis 21 to assume the closed position as suggested, for example, in FIGS. 10 and 11.

Retractor bar return spring 62 is coupled at an upper end thereof to a spring mount 61 on latch retractor bar 36 and at a lower end thereof to a spring mount 63 on latch bar retractor retainer 37. In the illustrated embodiment, retractor bar return spring 62 is an elongated coiled extension spring as shown in FIG. 5.

Retractor bar lift handle 64 includes a hand grip 66 formed to include a finger receiver 68 and a pivot support arm 70 cantilevered to hand grip 66 and mounted at a free end thereof to a pivot pin 72 coupled to tube 29 of frame 25. Hand grip 66 is thus supported for pivotable movement about a pivot axis established by pivot pin 72 between a lowered position shown, for example, in FIGS. 1-3, 5, 7, and 8, and a raised position shown, for example, in FIG. 9. Hand grip 66 is pivotably coupled to an upper end of latch retractor bar 36 at pivot mount 74 as shown, for example, in FIGS. 5 and 7-9. In the lowered position of hand grip 66, latch bar retractor 36 remains in its lowered position. Movement of hand grip 66 to its raised position (as shown in FIG. 9) lifts latch retractor bar 36 upwardly in guide channel 38 provided in latch base 30 to move simultaneously both spring-biased upper and lower latches 24, 26 laterally to withdraw plunger posts 28 from post receivers 124, 126 formed in latch receiver frame 18.

In the embodiment illustrated in FIG. 4, a first handle component 81 is configured to mate with a second handle component 82 to form hand grip 66 and pivot support arm 70. Each component 81, 82 is a monolithic element molded of a suitable plastics material in the illustrated embodiment.

A handle lock 76 provides releasable means for retaining retractor bar lift handle 64 in the lowered position normally to retain plunger posts 28 in their projected positions shown, for example, in FIGS. 3-8. As suggested in FIG. 9, an operator can "release" handle lock 76 to allow manual movement of retractor bar lift handle 64 relative to latch base 30 to move latch retractor bar 36 upwardly and thus upper and lower latches 24, 26 laterally to withdraw plunger posts 28 from companion post receivers 124,1 26 formed in latch receiver frame 18.

In the illustrated embodiment, handle lock 76 comprises a lock arm 78, a trigger 80, and a trigger-biasing spring 84 as shown, for example, in FIGS. 4, 5, and 7. Lock arm 78 includes a retainer hook 85, a connector 86, and a pivot mount 87 at a junction between retainer hook 85 and connector 86 as shown, for example, in FIG. 4. A pivot pin 88 is coupled to hand grip 66 and arranged to mate with pivot mount 87 to support lock arm 78 for pivotable movement about a pivot axis established by pivot pin 88 between a locked position shown, for example, in FIGS. 5 and 7 and an unlocked position shown, for example, in FIG. 8. In the locked position, retainer hook 85 is arranged to extend into a hook receiver 89 formed in latch base 30 and to engage a hook retainer flange 90 provided at or near to hook receiver 89 to block withdrawal of retainer hook 85 from hook receiver 89 as shown best in FIG. 5. In the unlocked position, lock arm 78 has been pivoted to move in a counterclockwise direction about pivot pin 88 as suggested in FIG. 8 to disengage retainer hook 85 and hook retainer flange 90. This disengagement frees retractor bar lift handle 64 to be pivoted by a gate user also in a counterclockwise direction to assume the raised position shown in FIG. 9.

Trigger 80 comprises an arm actuator 91 coupled to connector 86 and an actuator pivot mount 92 coupled to a pivot pin 93 coupled to hand grip 66. Trigger-biasing spring 84 is interposed between a flange 94 included in hand grip 66 and an underside 95 of trigger 80 normally to yieldably bias trigger 80 to a raised position shown in FIG. 5 wherein a thumb portion 96 of actuator arm 91 projects outwardly through an aperture 97 formed in hand grip 66. In operation, a gate user pushes downwardly on thumb portion 96 to move actuator arm 91 against trigger-biasing spring 84 and "rotate" lock arm 78 about pivot pin 88 as suggested in FIG. 8 to disengage retainer hook 85 and hook retainer flange 90. Then the gate user can pivot retractor bar lift handle 64 in counterclockwise direction 98 as shown in FIG. 9 to allow gate 12 to be opened.

Figure 10:
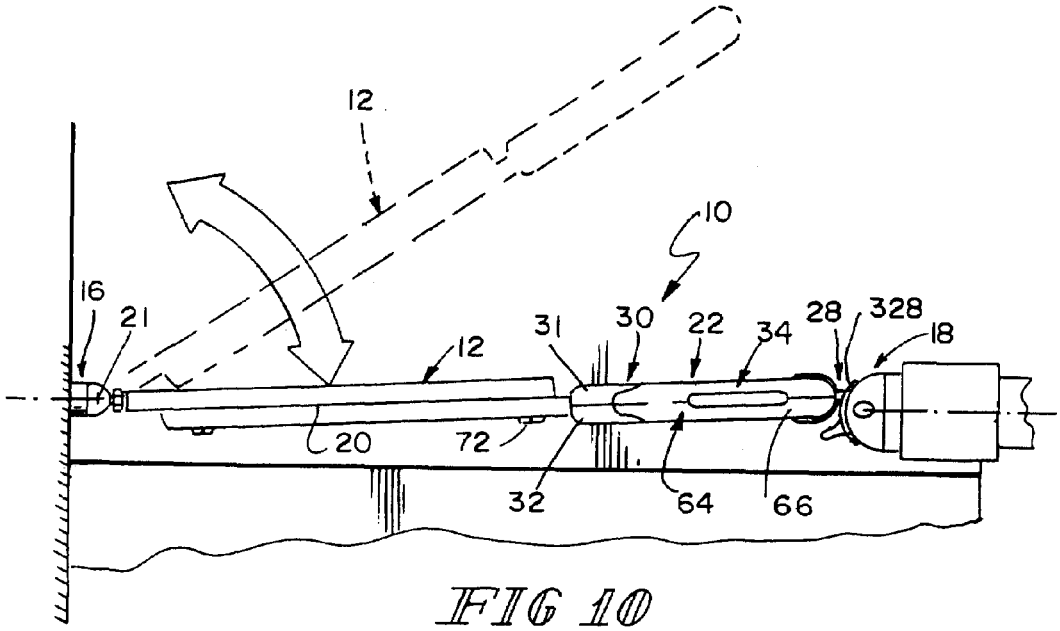
FIG. 10 is a top plan view similar to FIG. 2 showing the gate as it is being moved toward the closed position shown in FIG. 6.
Figure 11:
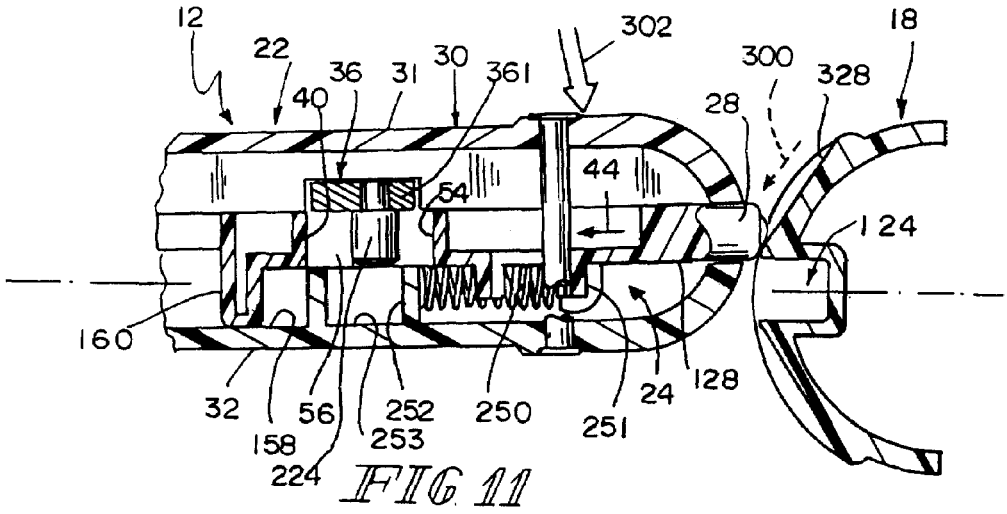
FIG. 11 is a sectional view of a portion of the hand-operated latch assembly and latch receiver frame, similar to FIG. 6 and taken along line 6-6 of FIG. 4, showing a plunger post riding up a ramp on the latch receiver frame (in the direction of the dashed arrow) causing the upper latch (including the plunger post) to move to the left against a yieldable biasing force generated by the coiled compression spring as the gate is being moved to the closed position as shown in FIG. 6 so that the plunger post "clears" the latch receiver frame and is ready to "snap" (to the right) into the post receiver formed in the latch receiver frame upon arrival of the gate at the closed position.

As suggested in FIGS. 10 and 11, plunger post 28 of upper latch 24 "rides up" (i.e., moves along) a receiver ramp 328 formed on an exterior portion of latch receiver frame 18 in direction 300 when gate 12 is moved by closing force 302 to contact latch receiver frame 18 during gate closure. Camming movement of plunger post 28 on receiver ramp 328 causes upper latch 24 to move laterally (to the left) in direction 44 to cause plunger post 28 to move in upper aperture 128 to retract into the interior region of latch base 30. Such retraction of plunger post 28 against a normal spring-biasing force generated by spring 250 allows plunger post 28 to "clear" latch receiver frame 18. Plunger post 28 is thus ready to "snap into" post receiver 124 formed in latch receiver frame 18 (under the spring-biasing force provided by spring 250) upon arrival of gate 12 at the closed position.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A gate unit comprising a gate mount, a gate mounted on a portion of the gate mount for movement between an opened position and a closed position, a latch mounted on the gate, the latch including a latch retraction pin and a spring-biased post carrier having a plunger post connected thereto, the plunger post being biased to an extended position via a spring coupled to the post carrier and to the gate, and the post carrier further including a peripherally enclosed opening having a plurality of walls, one of the walls forming a substantially linear latch retraction ramp and wall sections of two of the remaining plurality of walls each forming a stop at a respective end of the latch retraction ramp, the stops preventing the latch retraction pin from moving beyond the ends of the latch retraction ramp, and latch drive means mounted on the gate for interacting with the latch retraction ramp via the latch retraction pin to urge the spring-biased post carrier and plunger post to a retracted position.

2. The gate unit of claim 1, wherein the latch drive means further includes a receiver ramp on the gate mount configured to cooperate with the plunger post such that, when the gate is moved by a closing force toward the closed position, the plunger post will engage the receiver ramp and, a camming movement of the plunger post on the receiver ramp causes the post carrier and plunger post to move to the retracted position and places the plunger post in position to once the gate is in the closed position extended position and into a post receiver on the gate mount.

3. The gate unit of claim 1, wherein the latch drive means includes a handle and a latch retraction bar that includes the latch retraction pin, the handle and latch retraction bar cooperating such that upon upward movement of the handle the latch retraction pin rides on the latch retraction ramp between the stops causing the post carrier to move against the spring to withdraw the plunger post from a post receiver on the gate mount when the gate is in the closed position, thereby allowing the gate to be moved to the opened position.

4. The gate unit of claim 3, further comprising a latch base, wherein the latch retraction bar includes a retractor bar return spring connected to the latch base and the retractor bar return spring biases the latch retraction bar such that the plunger post is biased toward the extended position.

5. The gate unit of claim 3, wherein the plunger post is movable from the extended position to the retracted position without moving the handle.

6. The gate unit of claim 1, wherein the latch drive means includes a latch mover having the latch retraction pin mounted thereon and the latch retraction pin is configured to extend into the enclosed opening, the latch retraction pin is arranged for movement along the latch retraction ramp between the stops such that, when the gate is in the closed position and the latch retraction pin is in a specified position on the latch retraction ramp, the spring urges the plunger post into a post receiver on the gate mount.

7. The gate unit of claim 6, wherein the latch retraction ramp is inclined.

8. A gate unit comprising a gate mount including a latch receiver frame having a post receiver, a gate mounted on a portion of the gate mount for movement on the gate mount between an opened position and a closed position, and a latch assembly including a latch having a peripherally enclosed opening having a plurality of walls, one of the walls forming a substantially linear latch retraction ramp and two of the remaining wall sections of plurality of walls each forming a stop at a respective end of the latch retraction ramp, the latch assembly further including a plunger post configured to mate with the post receiver, a latch base, and a latch mover mounted for movement on the latch base to move the latch, the plunger post being carried on a post carrier of the latch and the latch having a guide slot configured to receive a guide pin coupled to the latch base, and the latch mover including a latch retractor pin which rides on the latch retraction ramp between the stops, the stops preventing the latch retractor pin from moving beyond both ends of the latch retraction ramp, movement of the latch mover in a first direction permits the plunger post to be urged into an extended position and into the post receiver when the gate is in the closed position.

9. The gate unit of claim 8, wherein movement of the latch mover in a second direction causes the plunger post to be withdrawn into a retracted position which permits a user to move the gate to the opened position.

10. The gate unit of claim 8, wherein the latch mover includes a latch retractor bar and a latch retractor bar return spring attached thereto and the retractor bar return spring is connected to the latch base and biases the latch retractor bar towards a lowered position such that when the latch retractor bar is in the lowered position, the interaction of the latch retractor pin and the enclosed opening allows movement of the latch toward the latch receiver frame and projection of the plunger post into the post receiver when the gate is in the closed position.

11. The gate unit of claim 10, wherein the latch mover further includes a latch retractor bar lift handle mounted to move relative to the latch base and configured to move the latch retractor bar in an upward direction against biasing forces of the latch retractor bar return spring to cause movement of the latch retractor pin along the latch retraction ramp which causes movement of the latch and plunger post into a retracted position.

12. The gate unit of claim 8, wherein the enclosed opening is triangular-shaped.

13. The gate unit of claim 8, wherein the latch assembly includes a second said latch and the latch receiver frame includes a second said post receivers.

14. The gate unit of claim 13, wherein said second latch includes an enclosed opening configured to receive a second latch retractor pin.

15. The gate unit of claim 13, wherein each latch includes a spring with one end thereof mounted on the post carrier and the other end thereof connected to the latch base and the springs are expandable yieldably to urge the plunger posts toward the extended position.

16. A gate unit comprising a gate mount including a latch receiver frame having a post receiver, a gate mounted on a portion of the gate mount for movement between an opened position and a closed position, and a latch mechanism mounted on the gate, the latch mechanism comprising a latch base including an aperture, a latch including a post carrier having a plunger post coupled to the post carrier, the post carrier including a guide slot sized to receive a guide pin coupled to the latch base, and the post carrier further including a peripherally enclosed pin-receiving opening having a plurality of walls, one of the walls forming a substantially linear inclined latch retractor ramp, and wall sections of two of the remaining plurality of walls each forming a stop at a respective end of the inclined retractor ramp, the latch mechanism further including and a latch retractor bar being mounted on the latch base and having a latch retractor pin movable along the latch retractor ramp between the stops, the stops preventing the latch retractor pin from moving beyond both ends of the latch retractor ramp and the latch is movable between an extended position and a retracted position.

17. The gate unit of claim 16, wherein the gate mount includes a ramp formed on an exterior portion of the latch receiver frame and the gate mount ramp is configured to provide a riding surface for the plunger post when the gate is moved by a closing force from the opened position to the closed position.

18. The gate unit of claim 17, wherein the post carrier includes a spring to urge the plunger post through the aperture on the latch base and, upon movement of the plunger post on the riding surface of the gate mount ramp, the post carrier is urged away from the latch receiver frame against a biasing force of the spring causing the plunger post to move toward the retracted position thereby allowing the plunger post to then move into the post receiver when the gate is in the closed position.

* * * * *